US007403134B2

(12) United States Patent
Kong

(10) Patent No.: US 7,403,134 B2
(45) Date of Patent: Jul. 22, 2008

(54) VEHICLE DRIVER GUARDING SYSTEM USING VEHICLE TELEMATICS SERVICE AND CONTROL METHOD THEREOF

(75) Inventor: Byong Yong Kong, Icheon-si (KR)

(73) Assignee: Hyundai Autonet Co., Ltd., Icheon-Si (KR)

( * ) Notice: Subject to any disclaimer, the term of this patent is extended or adjusted under 35 U.S.C. 154(b) by 256 days.

(21) Appl. No.: 11/259,562

(22) Filed: Oct. 26, 2005

(65) Prior Publication Data

US 2007/0057819 A1 Mar. 15, 2007

(30) Foreign Application Priority Data

Sep. 15, 2005 (KR) ..... 10-2005-0086287

(51) Int. Cl.
*G08G 1/123* (2006.01)

(52) U.S. Cl. ..... 340/994; 340/905; 340/988; 340/990; 340/995.1; 340/995.13; 340/995.17; 701/24; 701/26; 701/208; 701/209; 701/215

(58) Field of Classification Search ..... 340/994, 340/905, 988, 990, 995.1, 995.13, 995.14, 340/995.17; 342/307.09, 357.06; 701/24, 701/26, 208, 209, 215
See application file for complete search history.

(56) References Cited

U.S. PATENT DOCUMENTS 6,484,092 B2 * 11/2002 Seibel ..... 701/209
7,026,984 B1 * 4/2006 Thandu et al. ..... 342/357.09
2004/0204847 A1 * 10/2004 Yanai
2006/0068822 A1 * 3/2006 Kalhan

FOREIGN PATENT DOCUMENTS

| | | |
|---|---|---|
| JP | 2003-179024 | 6/2003 |
| JP | 2003-179025 | 6/2003 |
| KR | 10-2005-0012306 | 7/2003 |

* cited by examiner

*Primary Examiner*—Hung T. Nguyen
(74) *Attorney, Agent, or Firm*—John K. Park; Park Law Firm

(57) ABSTRACT

A vehicle driver guarding system using a vehicle telematics service and a control method thereof are provided. The vehicle driver guarding system includes: a vehicle telematics system for receiving a final destination, calculating a final destination arrival expectation time, notifying a central information center of the calculated expectation time through a mobile communication system, receiving a vehicle driver guard confirmation message from the central information center, and transmitting a response message to the received confirmation message, to the central information center; and the central information center being notified of the expectation time, transmitting the vehicle driver guard confirmation message to the vehicle telematics system when the notified expectation time lapses and then a preset time lapses, and performing a vehicle driver guarding function upon non-reception of the response message within the preset time.

7 Claims, 2 Drawing Sheets

VEHICLE DRIVER GUARDING SYSTEM USING VEHICLE TELEMATICS SERVICE AND CONTROL METHOD THEREOF

CLAIMING FOREIGN PRIORITY

The applicant claims and requests a foreign priority, through the Paris Convention for the Protection of Industrial Property, based on a patent application filed in the Republic of Korea (South Korea) with the filing date of Sep. 15, 2005, with the patent application number 10-2005-0086287, by the applicant, the contents of which are incorporated by reference into this disclosure as if fully set forth herein.

BACKGROUND OF THE INVENTION

1. Field of the Invention

The present invention relates to a vehicle driver guarding system and a control method thereof, and more particularly, to a vehicle driver guarding system using a position tracking service of a vehicle telematics service, and a control method thereof.

2. Description of the Related Art

In general, a vehicle telematics system detects occurrence of vehicle accident or theft, guides a vehicle running path, and provides a vehicle driver with a variety of other information using a mobile communication method and a position tracking method associated with Internet. In other words, the vehicle telematics system provides information through a vehicle based on a mobile communication system and a navigation system using a global positioning system (Hereinafter, referred to as "GPS") satellite. In other words, the vehicle telematics system provides a variety of vehicle telematics services, such as traffic information, countermeasure to emergency situation, remote vehicle diagnosis, and use of Internet (for example, financial transaction, provision of news, and transmission and reception of e-mail), using the navigation system and the mobile communication system.

At present, the vehicle using the vehicle telematics system can communicate information such as a current vehicle position and a traffic circumstance, using a position tracking function of the navigation system. In case where a vehicle accident occurs, a central information center recognizes that the vehicle accident occurs, and provides a service for occurrence of the vehicle accident. However, the service for the accident occurrence is provided in a format of notifying the vehicle accident after the vehicle accident occurs, and is impossible to guard the vehicle driver in case where the vehicle accident does not occur or the vehicle driver does not directly separately notify the central information center of the vehicle accident.

However, at present, the traffic circumstance and a variety of general traffic circumstances threaten a safety of the vehicle driver and accordingly, it is being required for a method for guarding the vehicle driver even when a direct vehicle accident does not occur or the vehicle driver does not directly separately notify the central information center of the vehicle accident.

SUMMARY OF THE INVENTION

Accordingly, the present invention is directed to a vehicle driver guarding system and a control method thereof that substantially overcome one or more of the limitations and disadvantages of the conventional art.

One object of the present invention is to provide a vehicle driver guarding system using a position tracking service of a vehicle telematics service, and a control method thereof.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims as well as the appended drawings.

To achieve the above and other objects and advantages, and in accordance with the purpose of the invention, as embodied and broadly described herein, there is provided a vehicle driver guarding system using a vehicle telematics service, the system including: a vehicle telematics system for receiving a final destination, calculating a final destination arrival expectation time being a time taken to arrive at the received final destination, notifying a central information center of the calculated expectation time through a mobile communication system, receiving a vehicle driver guard confirmation message from the central information center through the mobile communication system under a predetermined control, and transmitting a response message to the received confirmation message, to the central information center through the mobile communication system; and the central information center being notified of the final destination arrival expectation time, transmitting the vehicle driver guard confirmation message to the vehicle telematics system through the mobile communication system when the notified expectation time lapses and then a preset time lapses, and performing a vehicle driver guarding function upon non-reception of the response message to the vehicle driver guard confirmation message within the preset time.

In another aspect of the present invention, there is provided a control method of a vehicle driver guarding system using a vehicle telematics service, the method including the steps of: in a vehicle telematics system, receiving a final destination, calculating a final destination arrival expectation time being a time taken to arrive at the received final destination, and notifying a central information center of the calculated expectation time through a mobile communication system; in the central information center, being notified of the final destination arrival expectation time from the vehicle telematics system, and determining whether or not the notified expectation time lapses; in the central information center, when it is determined as the determination result that the notified expectation time lapses, determining whether or not a preset time lapses; in the central information center, when it is determined as the determination result that the preset time lapses, transmitting a vehicle driver guard confirmation message to the vehicle telematics system through the mobile communication system; and in the central information center, performing a vehicle driver guarding function upon non-reception of a response message to the vehicle driver guard confirmation message from the vehicle telematics system within the preset time.

It is to be understood that both the foregoing summary and the following detailed description of the present invention are merely exemplary and intended for explanatory purposes only.

BRIEF DESCRIPTION OF THE DRAWINGS

The accompanying drawings, which are included to aid in understanding the invention and are incorporated into and constitute a part of this application, illustrate embodiment(s) of the invention and together with the description serve to explain the principles of the invention. In the drawings.

DETAILED DESCRIPTION OF THE INVENTION

Figure 1:
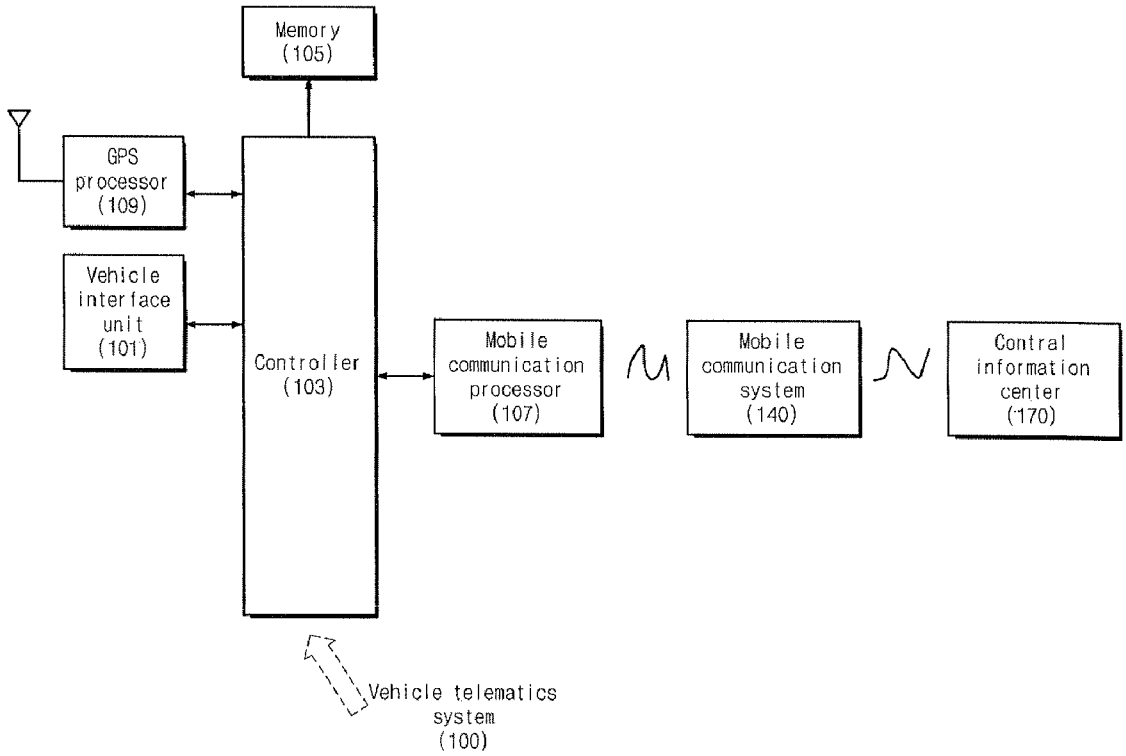
FIG. 1 schematically illustrates a connection relation between a vehicle telematics system and a central information center that perform a function according to an embodiment of the present invention.

Reference will now be made in detail to the preferred embodiments of the present invention, examples of which are illustrated in the accompanying drawings. Wherever possible, the same reference numerals will be used throughout the drawings to refer to the same or like parts.

The present invention provides a vehicle driver guarding system and a control method thereof. In particular, the present invention provides the vehicle driver guarding system and the control method thereof, for guarding the vehicle driver using a position tracking service of a vehicle telematics service even when a vehicle accident does not occur or a vehicle driver does not separately notify a central information center.

FIG. 1 schematically illustrates a connection relation between a vehicle telematics system and a central information center that perform a function according to an embodiment of the present invention.

Referring to FIG. 1, the vehicle telematics system 100 interfaces with a mobile communication system 140 in a mobile communication method, and the mobile communication system 140 transmits data corresponding to a result of interfacing with the vehicle telematics system 100, to the central information center 170. Here, the mobile communication method can be various methods such as a code division multiple access (CDMA) and a time division multiple access (TDMA). The mobile communication method itself has no direct relation with the present invention and therefore, its detailed description will be omitted.

The central information center 170 transmits data to the vehicle telematics system 100 through the mobile communication system 140.

The vehicle telematics system 100 includes a vehicle interface unit 101; a controller 103; a memory 105; a mobile communication processor 107; and a global position system (GPS) processor 109.

The vehicle interface unit 101 interfaces a vehicle with the vehicle telematics system 100 for a vehicle telematics service. In other words, the vehicle interface unit 101 communicates a variety of data for providing the vehicle telematics service, such as vehicle management, vehicle anti-theft, vehicle diagnosis, and notification of vehicle emergency, with the vehicle, and interfaces the vehicle with the vehicle telematics system 100.

The controller 103 controls a general operation of the vehicle telematics system 100. Specifically, the controller 103 communicates the data with the vehicle interface unit 101 or the GPS processor 109, and communicates the data with the mobile communication system 140 through the mobile communication processor 107 in the mobile communication method. The memory 105 includes a program memory and a data memory. The program memory stores each program of the vehicle telematics system 100. The data memory stores contents of a variety of resources of the vehicle telematics system 100, and temporarily stores data generated in execution of the program.

The mobile communication processor 107 processes the data communicated with the vehicle interface unit 101 and the data communicated with the GPS processor 109 in the mobile communication method under the control of the controller 103, and interfaces with the mobile communication system 140.

The mobile communication system 140 transmits the data from the vehicle telematics system 100 to the central information center 170. The central information center 170 receives the data from the vehicle telematics system 100, that is, from the mobile communication system 140, and provides the vehicle telematics service corresponding to the received data to the vehicle telematics system 100.

FIG. 1 illustrates the connection relation between the vehicle telematics system and the central information center for performing the function according to the embodiment of the present invention. Next, a procedure of guarding the vehicle driver using the vehicle telematics service according to an embodiment of the present invention will be described with reference to FIG. 2.

Figure 2:
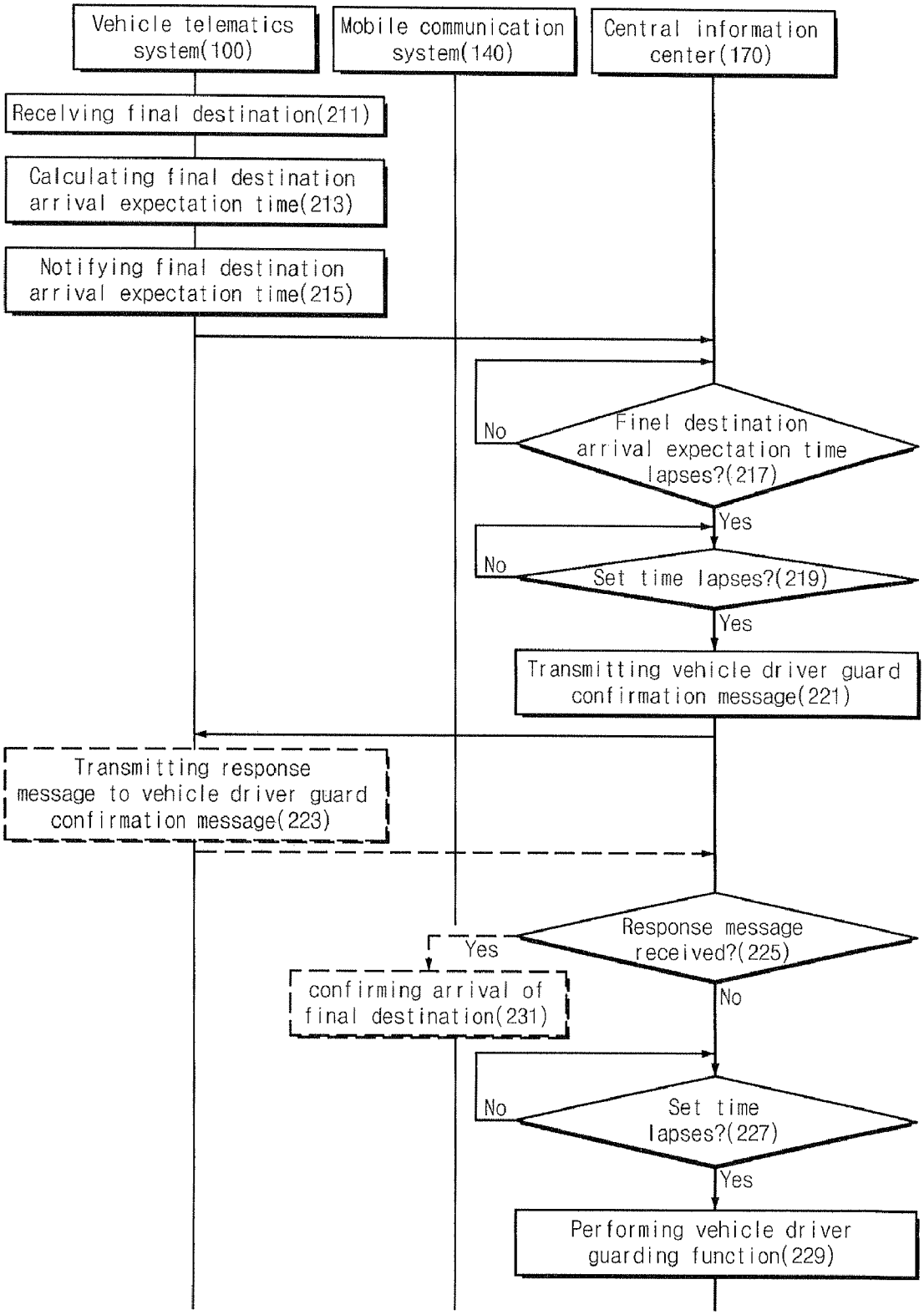
FIG. 2 is a signal flowchart illustrating a procedure of guarding a vehicle driver using a vehicle telematics service according to an embodiment of the present invention.

FIG. 2 is a signal flowchart illustrating the procedure of guarding the vehicle driver using the vehicle telematics service according to the embodiment of the present invention.

Referring to FIG. 2, the vehicle telematics system 100 receives a final destination where the vehicle should finally arrive (Step 211). Next, the vehicle telematics system 100 calculates a final destination arrival expectation time taken for the vehicle to arrive at the received final destination in consideration of a vehicle running speed and a traffic circumstance, for example, a traffic circumstance such as a traffic stagnation or a road construction (Step 213). A method of calculating the final destination arrival expectation time can be variously provided, and the calculating of the final destination arrival expectation time itself has no direct relation with the present invention and therefore, its detailed description will be omitted.

The vehicle telematics system 100 notifies the central information center 170 of the calculated expectation time through the mobile communication system 140 (Step 215). The central information center 170 is notified of the final destination arrival expectation time from the vehicle telematics system 100, and waits for the final destination arrival expectation time. As such, the central information center 170 waits for the final destination arrival expectation time and then, determines whether or not the final destination arrival expectation time lapses (Step 217).

In case where it is determined as the determination result that the final destination arrival expectation time lapses, the central information center 170 determines whether or not a preset time lapses (Step 219). In case where it is determined as the determination result that the preset time lapses, the central information center 170 transmits a vehicle driver guard confirmation message to the vehicle telematics system 100 through the mobile communication system 140 since the vehicle does not yet arrive at the final destination despite having to do so (Step 221).

Upon reception of the vehicle driver guard confirmation message from the central information center 170, the vehicle telematics system 100 transmits a response message to the vehicle driver guard confirmation message to the central information center 170 through the mobile communication system 140 (Step 223). If so, even when the actual final destination arrival expectation time lapses and then, even the preset time lapses, it can be determined that the vehicle driver is normally guarded.

However, unlike this, there may be a case where, despite that the central information center 170 transmits the vehicle driver guard confirmation message to the vehicle telematics system 100, it does not receive the response message to the vehicle driver guard confirmation message from the vehicle telematics system 100. In other words, after transmitting the response message to the vehicle driver guard confirmation message to the vehicle telematics system 100, the central information center 170 determines whether or not receiving the response message to the vehicle driver guard confirmation message (Step 225). In case where it is determined as the determination result to receive the response message to the vehicle driver guard confirmation message, it is confirmed that the vehicle arrives at the final destination and accordingly, it can be determined that the vehicle driver is normally guarded (Step 231).

In case where it is determined as the determination result not to receive the response message to the vehicle driver guard confirmation message, the central information center 170 determines whether or not the preset time lapses (Step 227). In case where it is determined as the determination result that the preset time lapses, since the actual final destination arrival expectation time lapses and then, even the preset time lapses, the central information center 170 determines that the vehicle driver is under emergency circumstance, and performs the vehicle driver guarding function (Step 229).

Here, the vehicle driver guarding function refers to a function of communicating through the emergency call center or the telephone number previously registered by the vehicle driver, and tracking the current vehicle position. FIG. 2 illustrates the function of communication and vehicle position track as an example of the vehicle driver guarding function but it is, of course, that the vehicle driver guarding function can be variously realized without limit.

As described above, the present invention has an advantage in that the vehicle driver can be guarded using the position tracking service of the vehicle telematics service, thereby guarding the vehicle driver even when the direct vehicle accident does not occur or the vehicle driver does not directly separately notify the central information center.

While the present invention has been described with reference to exemplary embodiments thereof, it will be apparent to those skilled in the art that various modifications can be made therein without departing from the spirit and scope of the invention as defined by the appended claims and their equivalents.

What is claimed is:

1. A vehicle driver guarding system using a vehicle telematics service, the system comprising:

a vehicle telematics system; and a central information center configured to communicate with the vehicle telematics system through a mobile communication system and initiate a vehicle driver guarding function upon non-reception of a predetermined response from the vehicle telematics system, wherein the vehicle telematics system is configured to receive a final destination, calculate a final destination arrival expectation time being a time taken to arrive at the received final destination, notify the central information center of the calculated expectation time through the mobile communication system, receive a vehicle driver guard confirmation message from the central information center through the mobile communication system under a predetermined control, and transmit a response message to the received confirmation message, to the central information center through the mobile communication system, wherein the central information center is configured to be notified of the final destination arrival expectation time, transmit the vehicle driver guard confirmation message to the vehicle telematics system through the mobile communication system when the notified expectation time lapses and then a preset time lapses, and perform a vehicle driver guarding function upon non-reception of the response message to the vehicle driver guard confirmation message within the preset time.

2. The system according to claim 1, wherein the vehicle telematics system calculates the final destination arrival expectation time for the received final destination, correspondingly to a vehicle running speed and a traffic circumstance.

3. The system according to claim 1, wherein the central information center performs communication using an emergency call center or a telephone number previously registered by a vehicle driver, tracks a current vehicle position to perform the vehicle driver guarding function.

4. A control method of a vehicle driver guarding system using a vehicle telematics service, the method comprising:

performing, in a vehicle telematics system, receiving a final destination, calculating a final destination arrival expectation time being a time taken to arrive at the received final destination, and notifying a central information center of the calculated expectation time through a mobile communication system;

performing, in the central information center, being notified of the final destination arrival expectation time from the vehicle telematics system, and determining whether or not the notified expectation time lapses;

performing, in the central information center, when it is determined as the determination result that the notified expectation time lapses, determining whether or not a preset time lapses;

performing, in the central information center, when it is determined as the determination result that the preset time lapses, transmitting a vehicle driver guard confirmation message to the vehicle telematics system through the mobile communication system; and performing, in the central information center, a vehicle driver guarding function upon non-reception of a response message to the vehicle driver guard confirmation message from the vehicle telematics system within the preset time.

5. The method according to claim 4, further comprising performing, in the central information center, confirming that the vehicle arrives at the final destination upon reception of the response message to the vehicle driver guard confirmation message from the vehicle telematics system within the preset time.

6. The method according to claim 4, wherein in the calculating of the final destination arrival expectation time, the vehicle telematics system calculates the final destination arrival expectation time for the received final destination correspondingly to a vehicle running speed and a traffic circumstance.

7. The method according to claim 4, wherein performing a vehicle driver guarding function comprises performing communication using an emergency call center or a telephone number previously registered by a vehicle driver, and tracks a current vehicle position.

* * * * *